US011798513B2

(12) United States Patent
Han

(10) Patent No.: US 11,798,513 B2
(45) Date of Patent: Oct. 24, 2023

(54) LIQUID CRYSTAL DISPLAY DEVICE AND METHOD FOR DRIVING THE SAME

(71) Applicant: Samsung Electronics Co., Ltd., Suwon-si (KR)

(72) Inventor: Yizhan Han, Suwon-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 0 days.

(21) Appl. No.: 17/565,967

(22) Filed: Dec. 30, 2021

(65) Prior Publication Data

US 2022/0215811 A1 Jul. 7, 2022

(30) Foreign Application Priority Data

Jan. 7, 2021 (CN) ..... 202110016419.6

(51) Int. Cl.
*G09G 3/36* (2006.01)

(52) U.S. Cl.
CPC ..... *G09G 3/3688* (2013.01); *G09G 3/3614* (2013.01); *G09G 2310/027* (2013.01); *G09G 2310/08* (2013.01)

(58) Field of Classification Search
CPC ... G09G 3/20; G09G 2360/16; G09G 2310/02
See application file for complete search history.

(56) References Cited

U.S. PATENT DOCUMENTS

| | | | | |
|---|---|---|---|---|
| 5,541,619 | A | 7/1996 | Hayashi et al. | |
| 2006/0125752 | A1 | 6/2006 | Moh | |
| 2009/0040242 | A1 | 2/2009 | Tomizawa et al. | |
| 2011/0134152 | A1* | 6/2011 | Furihata ..... | G09G 3/3648 345/690 |

(Continued)

FOREIGN PATENT DOCUMENTS

| | | | |
|---|---|---|---|
| CN | 1682146 | A | 10/2005 |
| CN | 1808551 | A | 7/2006 |

(Continued)

*Primary Examiner* — Van N Chow
(74) *Attorney, Agent, or Firm* — Harness, Dickey & Pierce, P.L.C.

(57) ABSTRACT

Provided are a liquid crystal display device and a method for driving the same. The liquid crystal display device includes: a display panel; a gate driver; a data driver; and a timing controller configured to control operations of the gate driver and the data driver, and the timing controller configured to output a data signal, an internal clock signal, and a polarity control signal to the data driver based on image data, wherein the data driver is configured to invert polarity of a data voltage every predetermined, or alternatively, desired rows based on the polarity control signal, and in a plurality of adjacent pixel rows loaded with data voltages of the same polarity, an on-width of the internal clock signal of a first pixel row is greater than that of the internal clock signals of other pixel rows; and wherein when an original grayscale value of a target pixel row in the other pixel rows is different from the original grayscale value of a previous pixel row in the other pixel rows, the timing controller is configured to automatically adjust the grayscale value of the target pixel row, and output the adjusted grayscale value as the data signal of the target pixel row.

16 Claims, 7 Drawing Sheets

(56) References Cited

U.S. PATENT DOCUMENTS

| | | | | |
|---|---|---|---|---|
| 2011/0279877 | A1* | 11/2011 | Nakajo | H04N 1/411 382/162 |
| 2011/0292012 | A1 | 12/2011 | Huang et al. | |
| 2014/0232624 | A1 | 8/2014 | Kim et al. | |
| 2021/0319250 | A1* | 10/2021 | Chen | G06V 10/761 |
| 2022/0215811 | A1* | 7/2022 | Han | G09G 3/3614 |

FOREIGN PATENT DOCUMENTS

| | | | |
|---|---|---|---|
| CN | 101248481 | A | 8/2008 |
| CN | 101833921 | A | 9/2010 |
| CN | 102262865 | A | 11/2011 |
| CN | 102376274 | A | 3/2012 |
| CN | 103996383 | A | 8/2014 |
| CN | 106531114 | A | 3/2017 |
| CN | 206209225 | U | 5/2017 |
| CN | 110085182 | A | 8/2019 |
| CN | 110189726 | A | 8/2019 |
| CN | 111028761 | A | 4/2020 |
| CN | 111883082 | A | 11/2020 |
| JP | H02137887 | A | 5/1990 |
| KR | 20040006251 | A | 1/2004 |

* cited by examiner

ORIGINAL GRAYSCALE VALUE OF PREVIOUS PIXEL ROW

ORIGINAL GRAYSCALE VALUE OF TARGET PIXEL ROW

| Gray | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] | [illegible] |
|---|---|---|---|---|---|---|---|---|---|---|---|---|---|---|---|---|---|---|
| [illegible] | 0 | 0 | 0 | 0 | 0 | 0 | 0 | 0 | 0 | 0 | 0 | 0 | 0 | 0 | 0 | 0 | 0 | 0 |
| [illegible] | 17 | 16 | 15 | 14 | 13 | 12 | 11 | 8 | 7 | 6 | 6 | 5 | 5 | 5 | 4 | 4 | 4 | |
| [illegible] | 35 | 34 | 32 | 30 | 28 | 26 | 25 | 24 | 22 | 21 | 20 | 18 | 17 | 16 | 14 | 13 | 12 | |
| [illegible] | 53 | 51 | 49 | 48 | 46 | 44 | 42 | 40 | 38 | 36 | 34 | 32 | 30 | 28 | 26 | 24 | 22 | |
| [illegible] | 69 | 68 | 67 | 66 | 64 | 62 | 60 | 58 | 56 | 54 | 52 | 50 | 48 | 46 | 44 | 42 | 40 | |
| [illegible] | 87 | 85 | 84 | 83 | 81 | 80 | 78 | 76 | 74 | 72 | 70 | 68 | 66 | 64 | 62 | 60 | 58 | |
| [illegible] | 104 | 102 | 101 | 100 | 98 | 97 | 96 | 95 | 94 | 92 | 90 | 88 | 86 | 84 | 82 | 80 | 78 | |
| [illegible] | 121 | 120 | 118 | 117 | 115 | 114 | 113 | 112 | 111 | 110 | 108 | 106 | 104 | 102 | 100 | 98 | 96 | |
| [illegible] | 138 | 137 | 136 | 134 | 133 | 131 | 130 | 129 | 128 | 127 | 126 | 124 | 122 | 120 | 118 | 116 | 114 | |
| [illegible] | 156 | 153 | 153 | 151 | 150 | 149 | 147 | 146 | 145 | 144 | 143 | 141 | 139 | 137 | 135 | 133 | 131 | |
| [illegible] | 172 | 171 | 170 | 168 | 167 | 165 | 164 | 163 | 162 | 161 | 160 | 158 | 156 | 154 | 152 | 150 | 148 | |
| [illegible] | 189 | 188 | 187 | 185 | 184 | 183 | 182 | 181 | 179 | 178 | 177 | 176 | 174 | 172 | 170 | 168 | 166 | |
| [illegible] | 206 | 205 | 204 | 202 | 201 | 200 | 198 | 197 | 196 | 195 | 194 | 193 | 192 | 191 | 190 | 189 | 188 | |
| [illegible] | 223 | 222 | 221 | 219 | 218 | 216 | 215 | 214 | 213 | 212 | 211 | 210 | 209 | 208 | 207 | 206 | 205 | |
| [illegible] | 240 | 239 | 238 | 236 | 235 | 234 | 232 | 231 | 230 | 229 | 228 | 227 | 226 | 225 | 224 | 223 | 222 | |
| [illegible] | 254 | 253 | 252 | 251 | 250 | 249 | 248 | 247 | 246 | 245 | 244 | 243 | 242 | 241 | 240 | 240 | 239 | |
| [illegible] | 255 | 255 | 255 | 255 | 255 | 255 | 255 | 255 | 255 | 255 | 255 | 255 | 255 | 255 | 255 | 255 | 255 | |

FIG. 9

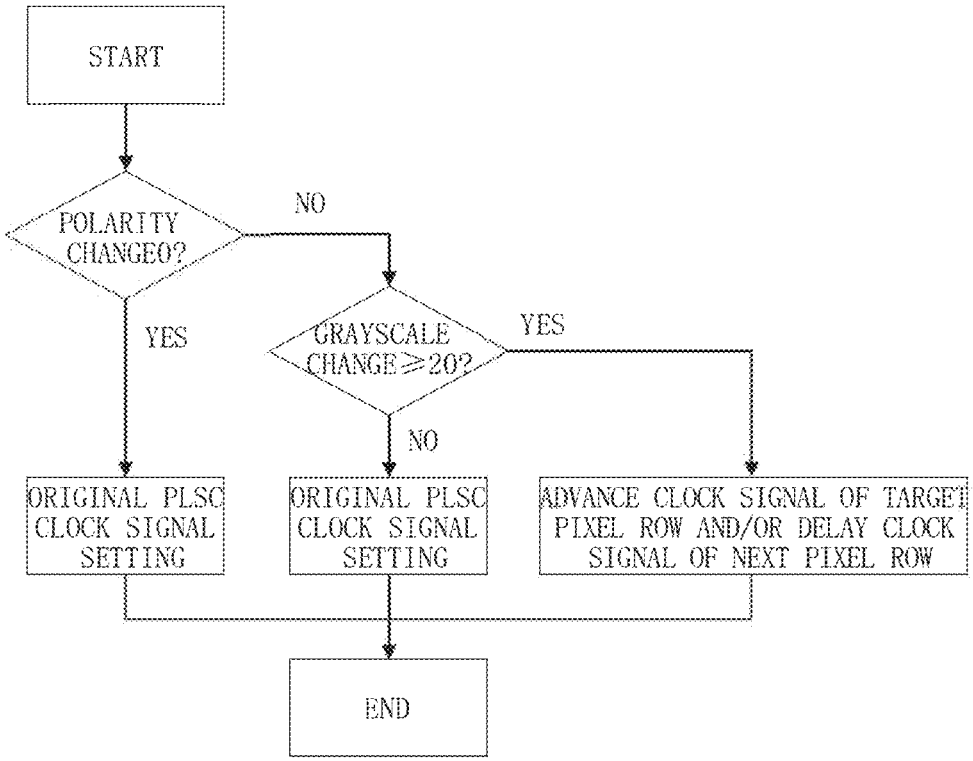

FIG. 10

LIQUID CRYSTAL DISPLAY DEVICE AND METHOD FOR DRIVING THE SAME

CROSS-REFERENCE TO RELATED APPLICATION

This application is based on and claims priority under 35 U.S.C. § 119 to Chinese Patent Application No. 202110016419.6, filed on Jan. 7, 2021, in the Chinese Intellectual Property Office, the disclosure of which is incorporated by reference herein in its entirety.

FIELD

Example embodiments of the present inventive concepts relate to a liquid crystal display device and a method for driving the same.

DESCRIPTION OF RELATED ART

Liquid crystal display devices (LCDs) display picture information using photoelectric properties of liquid crystals injected into a liquid crystal panel. LCDs have several advantageous characteristics of thinness, lightness in weight, low power consumption, and/or so on. For these reasons, LCDs are extensively used in a wide variety of applications, including display devices such as display monitors for portable computers, desktop computers, HD imaging systems, and the like.

A liquid crystal panel of an LCD generally includes two substrates and liquid crystals having a dielectric anisotropy are injected between the two substrates. Light transmission through the substrates is controlled by varying strengths of electric fields applied to the substrates, thereby controlling orientations of the liquid crystals and displaying a desired image.

Since liquid crystal material is generally deteriorated in its characteristics by a continuous application of an electric field in one direction, it may be desirable to (frequently) change the direction of the electric field by inverting polarities of data voltages relative to a reference voltage. Several methods of inverting the polarities of data voltages are suggested, for example, a dot inversion of inverting the polarities in a unit of pixels, a line inversion of inverting the polarities in a unit of rows, etc.

FIG. 2 illustrates a waveform diagram of a signal applied to the LCD when a Programmable Line Start Control (PLSC) function is used in the conventional art.

In FIG. 2, a display device displays an image based on image data DATA input from outside (externally). A timing controller of the display device may generate a polarity control signal POL and an internal clock signal CLK. When the polarity control signal POL is switched between a high level and a low level, the polarity of the data voltage is inverted in a subsequent pixel row, and when the polarity control signal POL is maintained at the high level or the low level, the polarity of the data voltage of subsequent N−1 pixel rows is maintained. For example, in FIG. 2, when the polarity control signal POL is switched from the low level to the high level, the polarity of the data voltage is inverted in the subsequent pixel row, and when the polarity control signal POL is maintained at the high level, the polarity of the data voltage of the subsequent N−1 pixel rows is maintained. In the example shown in FIG. 2, N may be 4. By increasing an on-width of the internal clock signal CLK applied to a first pixel row ① of the four consecutive pixel rows with the same polarity, a charging rate of the first pixel row ① may be enhanced, so that a less signal delay and a less charging ratio reduction are achieved. In addition, in the image data DATA, there is a horizontal blank period HBP between data signals RGB Data for every two rows, so that image data signals RGB Data for the two rows are not overlapped. However, when the PLSC function is applied, since a charging time of the first pixel row ① among the N lines becomes longer and a total duration of the clock signals corresponding to the N lines needs to remain unchanged, this may result in a decrease in the charging time of remaining pixel rows (a second pixel row ②, a third pixel row ③, and a fourth pixel row ④). In some example embodiments, a decrease in the charging time will reduce image quality, which means that the PLSC function is a degradation technology. In particular, if the charging time for the remaining pixel rows is reduced and/or grayscale changes of the remaining pixel rows are great (for example, the grayscale changes of the second pixel row ②, the third pixel row ③, and the fourth pixel row ④ are large), it will cause insufficient charging of the remaining pixel rows, and thus cause display defects.

FIG. 3 illustrates a waveform diagram of a specific example of the signal applied to the LCD when the PLSC function is used in the conventional art.

For example, in FIG. 3, a grayscale value of the image data DATA corresponding to the first pixel row ① may be 255, the grayscale value of the image data DATA corresponding to the second pixel row ② may be 255, the grayscale value of the image data DATA corresponding to the third pixel row ③ may be 60, and the grayscale value of the image data DATA corresponding to the fourth pixel row ④ may be 60. When switching from the grayscale of 255 of the second pixel row ② to the grayscale of 60 of the third pixel row ③, it will be difficult to reach the target grayscale of 60 due to insufficient charging of the third pixel row ③ caused by the decreased charging time, which results in a weak charging, and thereby (seriously) affecting the image quality of the panel. In particular, in an 8K-120 Hz-display panel, its charging time is only 1.1 μs, and in some example embodiments, the deterioration of image quality will be more pronounced.

Above information disclosed in this Background section is only for enhancement of understanding of the background and therefore it may contain information that does not constitute prior art.

SUMMARY

A purpose of the present disclosure is to provide a liquid crystal display device and a method of driving the same.

Example embodiments of the present disclosure provide a liquid crystal display device, which includes: a display panel configured to display an image; a gate driver configured to output a gate signal to a gate line of the display panel; a data driver configured to output a data voltage to a data line of the display panel; and a timing controller configured to control operations of the gate driver and the data driver, and the timing controller configured to output a data signal, an internal clock signal, and a polarity control signal to the data driver based on image data input externally, wherein the data driver is configured to invert polarity of the data voltage each of a predetermined, or alternatively, desired n (where n is an integer greater than or equal to 2) number of rows based on the polarity control signal, and in a plurality of adjacent pixel rows loaded with data voltages of the same polarity, an on-width of the internal clock signal of a first pixel row is greater than that of the internal clock signals of other pixel rows; and wherein when an original grayscale value of a target pixel row in the other pixel rows is different from the original grayscale value of a previous pixel row in the other pixel rows, the timing controller is configured to automatically adjust the grayscale value of the target pixel row, and outputs the adjusted grayscale value as the data signal of the target pixel row.

In the liquid crystal display device according to example embodiments of the present disclosure, when a difference between the original grayscale value of the target pixel row and the original grayscale value of the previous pixel row is less than a first threshold, the timing controller may output the original grayscale value of the target pixel row as the data signal; and when the difference between the original grayscale value of the target pixel row and the original grayscale value of the previous pixel row is larger than or equal to the first threshold, the timing controller may increase or decrease the original grayscale value of the target pixel row by a first predetermined or alternatively, desired value to determine the adjusted grayscale value of the target pixel row.

In the liquid crystal display device according to example embodiments of the present disclosure, the first threshold may be 100, and the first predetermined or alternatively, desired value may be 1.

In the liquid crystal display device according to example embodiments of the present disclosure, when the difference between the original grayscale value of the target pixel row and the original grayscale value of the previous pixel row is greater than or equal to a second threshold, the timing controller may adjust the on-width of the internal clock signal of the other pixel rows, such that the on-width of the internal clock signal of the target pixel row among the other pixel rows is greater than that of remaining pixel rows among the other pixel rows.

In the liquid crystal display device according to example embodiments of the present disclosure, the second threshold is greater than the first threshold.

In the liquid crystal display device according to example embodiments of the present disclosure, the second threshold may be 200.

In the liquid crystal display device according to example embodiments of the present disclosure, when the original grayscale value of the target pixel row is different from that of the previous pixel row, the timing controller may determine the adjusted grayscale value of the target pixel row based on a lookup table according to the original grayscale value of the target pixel row and the original grayscale value of the previous pixel row.

In the liquid crystal display device according to example embodiments of the present disclosure, when the difference between the original grayscale value of the target pixel row and the original grayscale value of the previous pixel row is greater than or equal to a predetermined or alternatively, desired threshold, the timing controller may adjust the on-width of the internal clock signal of the other pixel rows, such that the on-width of the internal clock signal of the target pixel row among the other pixel rows is greater than that of the remaining pixel rows among the other pixel rows.

In the liquid crystal display device according to example embodiments of the present disclosure, the predetermined or alternatively, desired threshold may be 200.

Example embodiments of the present disclosure provide a method for driving a liquid crystal display device, which includes: a display panel configured to display an image; a gate driver configured to output a gate signal to a gate line of the display panel; a data driver configured to output a data voltage to a data line of the display panel; and a timing controller configured to control operations of the gate driver and the data driver, and the timing controller outputting a data signal, an internal clock signal, and a polarity control signal to the data driver based on image data input from outside. The method includes: inverting polarity of the data voltage each of a predetermined, or alternatively, desired n (where n is an integer greater than or equal to 2) number of rows based on the polarity control signal, wherein in a plurality of adjacent pixel rows loaded with data voltages of the same polarity, an on-width of the internal clock signal of a first pixel row is greater than that of the internal clock signals of other pixel rows; and automatically adjusting the grayscale value of a target pixel row, and outputting the adjusted grayscale value as the data signal of the target pixel row when an original grayscale value of the target pixel row in the other pixel rows is different from the original grayscale value of a previous pixel row in the other pixel rows.

In the method according to example embodiments of the present disclosure, when a difference between the original grayscale value of the target pixel row and the original grayscale value of the previous pixel row is less than a first threshold, the original grayscale value of the target pixel row may be output as the data signal; and when the difference between the original grayscale value of the target pixel row and the original grayscale value of the previous pixel row is larger than or equal to the first threshold, the original grayscale value of the target pixel row may be increased or decreased by a first predetermined or alternatively, desired value to determine the adjusted grayscale value of the target pixel row.

In the method according to example embodiments of the present disclosure, the first threshold may be 100, and the first predetermined or alternatively, desired value may be 1.

In the liquid crystal display device according to example embodiments of the present disclosure, when the difference between the original grayscale value of the target pixel row and the original grayscale value of the previous pixel row is greater than or equal to a second threshold, the on-width of the internal clock signal of the other pixel rows may be adjusted, such that the on-width of the internal clock signal of the target pixel row among the other pixel rows is greater than that of remaining pixel rows among the other pixel rows, and wherein the second threshold is greater than the first threshold.

In the method according to example embodiments of the present disclosure, the second threshold may be 200.

In the method according to example embodiments of the present disclosure, when the original grayscale value of the target pixel row is different from that of the previous pixel row, the adjusted grayscale value of the target pixel row may be determined based on a lookup table according to the original grayscale value of the target pixel row and the original grayscale value of the previous pixel row.

In the method according to example embodiments of the present disclosure, when the difference between the original grayscale value of the target pixel row and the original grayscale value of the previous pixel row is greater than or equal to a predetermined or alternatively, desired threshold, the on-width of the internal clock signal of the other pixel rows may be adjusted, such that the on-width of the internal clock signal of the target pixel row among the other pixel rows is greater than that of the remaining pixel rows among the other pixel rows.

In the method according to example embodiments of the present disclosure, the predetermined or alternatively, desired threshold may be 200.

According to one or more aspects of the present disclosure, the present disclosure provides a liquid crystal display device and a method of driving the liquid crystal display device. When the Programmable Line Start Control (PLSC) function is used, as for other pixel rows among a plurality of adjacent pixel rows loaded with data voltages of same polarity except for a first pixel row, the liquid crystal display device provided by the present disclosure may automatically adjust a grayscale value and/or an on-width of an internal clock of a target pixel row by comparing the target pixel row among the other pixel rows with its previous pixel row, such that a real source level of the target pixel row is charged at a faster speed, and thus a target level is reached within a reduced time, thereby improving display effects.

BRIEF DESCRIPTION OF THE DRAWINGS

These and/or other aspects and advantages of the present disclosure will become apparent and more readily appreciated from the following detailed description of example embodiments of the present disclosure, taken in conjunction with the accompanying drawings in which:

FIG. 9 illustrates an example of an automatic adjustment processed by using a lookup table;

FIG. 10 illustrates a flowchart of an automatic adjustment processed by adjusting a clock signal.

DETAILED DESCRIPTION OF EXAMPLE EMBODIMENTS

Figure 1:
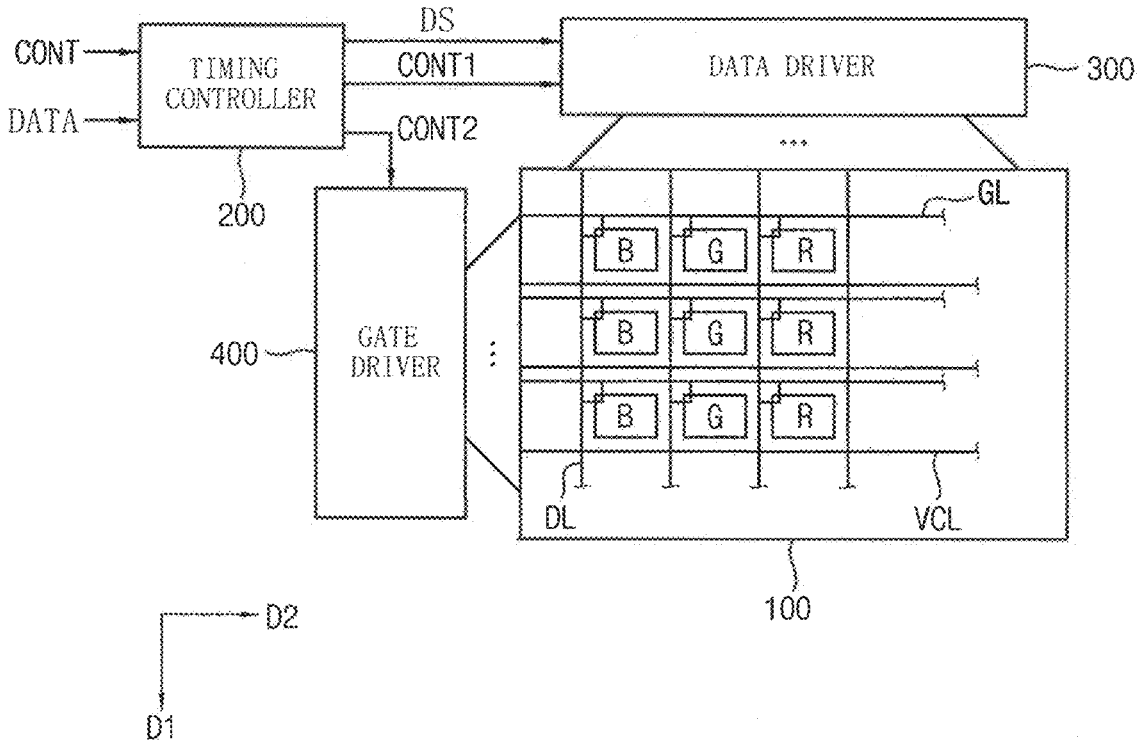
FIG. 1 is a block diagram of a liquid crystal display device according to example embodiments of the present inventive concepts.

Hereinafter, example embodiments of the present disclosure are described with reference to the accompanying figures in detail. Examples of example embodiments of the present disclosure are illustrated in the accompany drawings, wherein the same reference numeral indicates the same part throughout the accompany drawings. Example embodiments will be illustrated below with reference to the accompanying drawings, so as to explain the present disclosure.

FIG. 1 illustrates a block diagram of a liquid crystal display device according to example embodiments of the present inventive concepts.

Referring to FIG. 1, example embodiments of the display device may include a display panel 100, a timing controller 200, a data driver 300, and/or a gate driver 400.

The display panel 100 may include a plurality of data lines DL, a plurality of gate lines GL, a plurality of common voltage lines VCL, and/or a plurality of pixels. The data lines DL extend in a first direction D1 and are arranged in a second direction D2 crossing the first direction D1. The gate lines GL extend in the second direction D2 and are arranged in the first direction D1. The common voltage lines VCL extend in the second direction D2 and are arranged in the first direction D1.

The plurality of pixels are arranged in a matrix form including a plurality of pixel rows and a plurality of pixel columns. Each of the plurality of pixels may include a plurality of sub pixels. In one example embodiment, for example, one pixel may include a red sub pixel R, a green sub pixel G, and a blue sub pixel B.

Each sub pixel includes a switching transistor connected to the data line and the gate line, a liquid crystal capacitor connected to the switching transistor, and a storage capacitor connected to the liquid crystal capacitor. The common voltage line VCL transfers a common voltage to a common electrode of the storage capacitor.

Each of the red sub pixel R, the green sub pixel G, and the blue sub pixel B of the pixel has a short side corresponding to the first direction D1 and a long side corresponding to the second direction D2 and are connected to the same data line as each other.

The timing controller 200 is configured to generally control operations of the display device. The timing controller 200 is configured to receive image data DATA and a control signal CONT from an external device.

The timing controller 200 may provide, e.g., to the data driver 300, the scan driver 400, control signals suitable for specifications of the respective components. The timing controller 200 may be configured to output a data signal DS based on the image data DATA. The timing controller 200 may be configured to transmit the data signal DS to the data driver 300.

The timing controller 200 is configured to generate a plurality of control signals for driving the display panel 100 based on the control signal CONT. The plurality of control signals may include a first control signal CONT1 for driving the data driver 300, a second control signal CONT2 for driving the data driver 400. The configuration of the timing controller 200 will be described in detail with reference to FIG. 4. According to example embodiments, the first control signal CONT1 may include an internal clock signal CLK and a polarity control signal POL for controlling polarity of a data voltage applied to the data line (see FIG. 2). For example, the timing controller 200 may generate the polarity control signal POL and the internal clock signal CLK in response to a reference clock signal output from a clock source.

The data driver 300 is configured to convert the data signal DS supplied from the timing controller 200 into the data voltage based on the first control signal CONT1, and output the data voltage to the data line DL of the display panel 100. In some example embodiments, the data driver 300 inverts the polarity of the data voltage for each of a predetermined, or alternatively, desired n (where n is an integer greater than or equal to 2) number of rows, based on the polarity control signal POL. For example, the polarity control signal POL inverts the polarity of the data voltage every two rows. In some example embodiments, the polarity control signal POL inverts the polarity of the data voltage every three rows, every four rows or more rows. In addition, the timing controller 200 may adjust the internal clock signal CLK, for example, advance or delay the internal clock signal CLK. Therefore, as for a plurality of adjacent pixel rows loaded with data voltages of the same polarity, an on-width of the internal clock signal of a first pixel row is greater than that of the internal clock signals of other pixel rows. In some example embodiments, the timing controller 200 and the data driver 300 may commonly adjust the internal clock signal. For example, the timing controller 200 may output a clock signal with a fixed on-width and a control command for controlling the change of the on-width of the clock signal to the data driver 300, and the data driver 300 generates an adjusted internal clock signal based on the received clock signal and the received control command.

The gate driver 400 is configured to generate a plurality of gate signals and sequentially output the plurality of gate signals to the gate lines GL of the display panel 100. The gate driver 400 may include a shift register including a plurality of transistors directly integrated in the display panel 100.

When gate-on/off signals are sequentially applied to the gate lines, switching elements connected thereto are sequentially turned on. At the same time, image signals, that is, the data voltages (also referred as to gray voltages levels), which are applied to respective pixel electrodes in a pixel row, are provided to the data lines connected to the turned-on switching elements. The image signals provided to the data lines are applied to each pixel via the turned-on switching elements. In this manner, gate-on voltages are sequentially applied to all the gate lines to supply pixel signals to the pixels in all the rows during one frame cycle, thereby completing an image for one frame.

Alternatively, when an original grayscale value of a target pixel row in the other pixel rows is different from an original grayscale value of a previous pixel row, the timing controller 200 automatically adjusts the grayscale value of the target pixel row, and outputs the adjusted grayscale value as the data signal.

Figure 4:
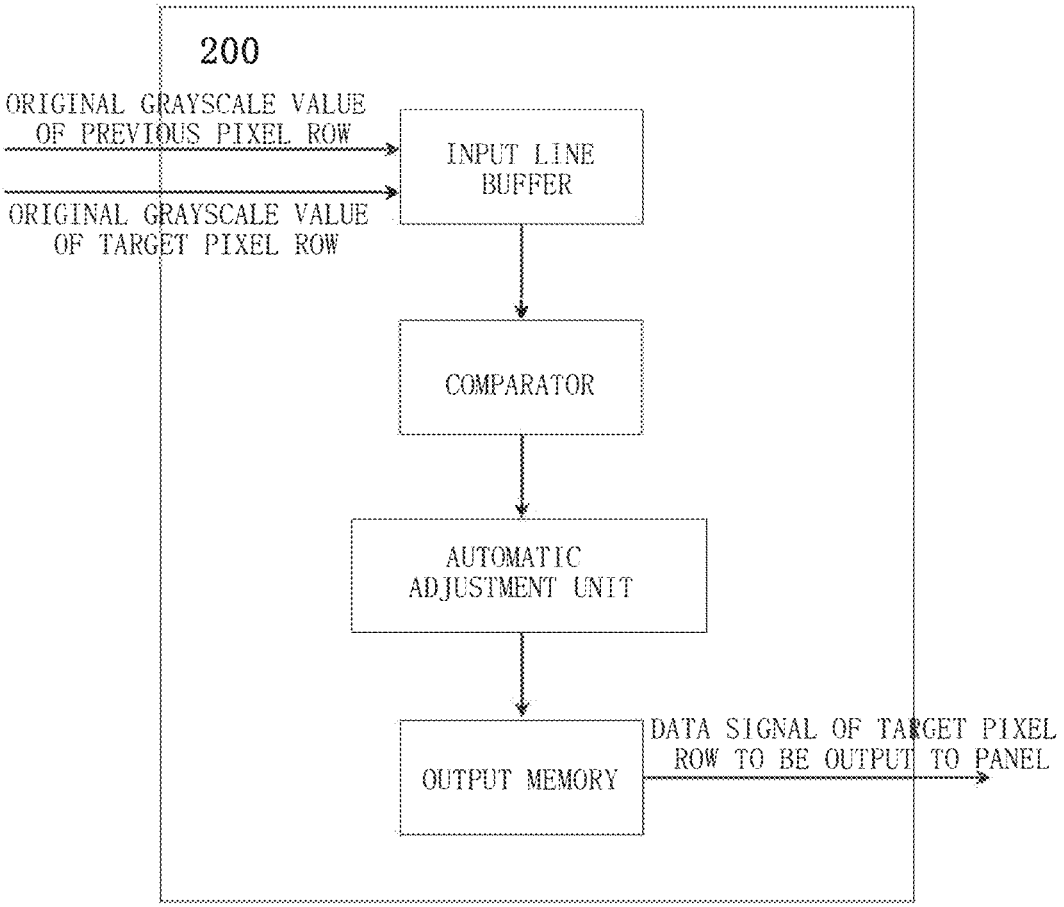
FIG. 4 illustrates a block diagram of a timing controller shown in FIG. 1.

FIG. 4 illustrates a block diagram of the timing controller 200 shown in FIG. 1.

In FIG. 4, the timing controller 200 includes a plurality of modules for automatically adjusting the grayscale value of the target pixel row. Herein, the target pixel row refers to a row of other pixel rows among the plurality of adjacent pixel rows loaded with data voltages of the same polarity except for a first pixel row. In some example embodiments, the timing controller 200 may include an input line buffer, a comparator, an automatic adjustment unit, and an output memory. In order to avoid redundancy, differences of the timing controller 200 of example embodiments of the present application from prior art will be mainly described on. Therefore, other modules/components of the timing controller for controlling the operations of the gate driver and the data driver are not shown.

In some example embodiments, the input line buffer receives image data from the outside. For example, the input line buffer can receive the original grayscale value of the target pixel row and the original grayscale value of the previous pixel row, and output the original grayscale value of the target pixel row and the original grayscale value of the previous pixel row to the comparator. The comparator compares the original grayscale value of the target pixel row with the original grayscale value of the previous pixel row and outputs a comparison result to the automatic adjustment unit. The automatic adjustment unit adjusts the grayscale value of the target pixel row according to the output result of the comparator and outputs the adjusted grayscale value to the output memory. The output memory outputs the adjusted grayscale value as the data signal of the target pixel row. For example, the output memory outputs the adjusted grayscale value as the data signal of the target pixel row to the data driver 300.

It should be noted that these example embodiments are only examples, and the present disclosure is not limited thereto, as long as the timing controller 200 may automatically adjust the target pixel row. Example embodiments of the present inventive concepts may be embodied directly in hardware, in a software module executed by a processor, or in a combination of them. For example, the automatic adjustment unit shown in FIG. 4 may be a control circuit or may be implemented as a look-up table stored in the timing controller.

Figure 5:
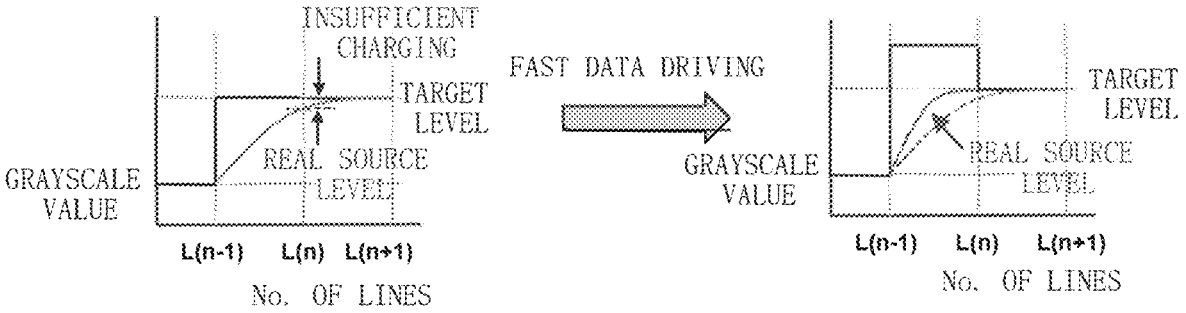
FIG. 5 illustrates a schematic diagram of a waveform of a fast data driving.

FIG. 5 illustrates a schematic diagram of a waveform of a fast data driving. An implementation of an automatic adjustment of the target pixel row by the fast data driving method will be described in more detail below with reference to FIG. 5.

As shown in FIG. 5, for other pixel rows L(n−1), L(n), and L(n+1), a charging time of pixel rows L(n−1), L(n), and L(n+1) is reduced due to use of the PLSC function. For example, the pixel row (n−1) has a lower grayscale value (for example, 50), and the pixel rows L(n) and L(n+1) have the same higher grayscale value (for example, 200). When switching from the pixel row L(n−1) to the pixel row L(n), due to a large grayscale change, a real source level of the pixel row L(n) cannot reach a target level in the reduced time, and thus the pixel row L(n) would be insufficiently charged. In some example embodiments, the grayscale value of the pixel row L(n) can be set to a value higher than its original grayscale value by a predetermined or alternatively, desired grayscale, so that the real source level of the pixel row L(n) is quickly charged, and therefore reaches the target level in the reduced time.

As shown in FIG. 5, the pixel row (n−1) has the lower grayscale value (for example, 50), and the pixel rows L(n) and L(n+1) have the same higher original grayscale value (for example, 200). The adjusted grayscale value of the pixel row L(n) is higher than the original grayscale value of the pixel row L(n) by the predetermined or alternatively, desired grayscale value (for example, 10). For example, the adjusted grayscale value of the pixel row L(n) is 210. In some example embodiments, the real source level of the pixel row L(n) may be charged at a faster speed and may reach the target level in the reduced time. It will be understood that a numerical range of the example discussed above with reference to FIG. 5 is only used to illustrate the principle of the present disclosure, and should not be construed in any way to limit the scope of the disclosure. In some example embodiments, when the original grayscale value of the pixel row L(n) is lower than the original grayscale value of the pixel row (n−1), the adjusted grayscale value of the pixel row L(n) may be lower than the original grayscale value of the pixel row L(n) by a predetermined or alternatively, desired grayscale value. The value of the predetermined or alternatively, desired grayscale value discussed above should be matched with the charging time of the pixel row L(n).

Figure 6:
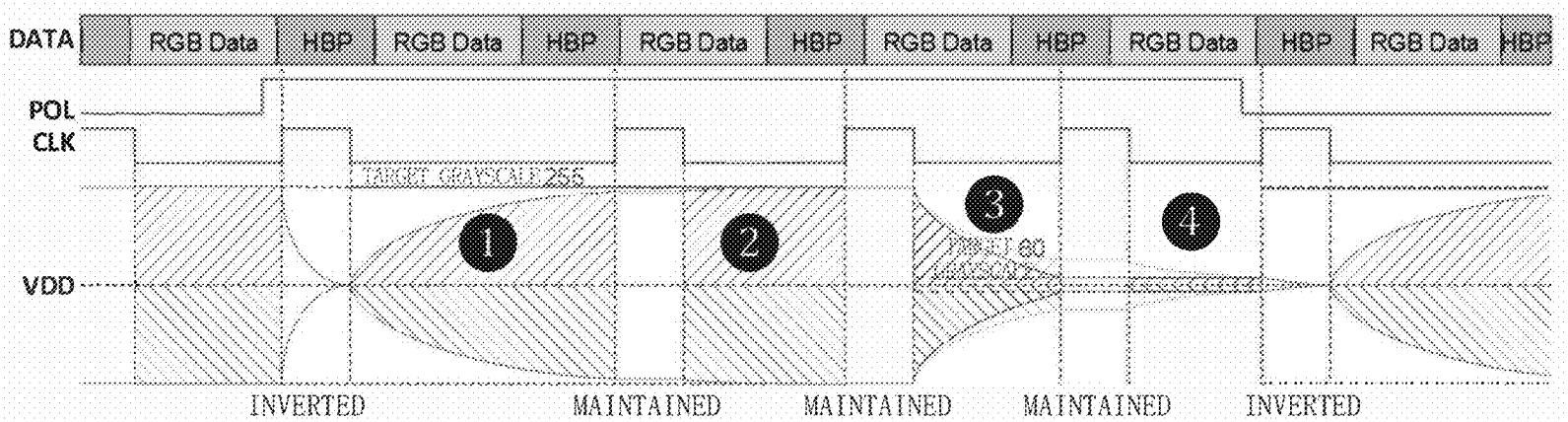
FIG. 6 illustrates a waveform diagram of an example of a signal applied to the LCD according to example embodiments of the present inventive concepts.

FIG. 6 illustrates a waveform diagram of a specific example of a signal applied to the LCD according to example embodiments of the present inventive concepts.

Figure 2:
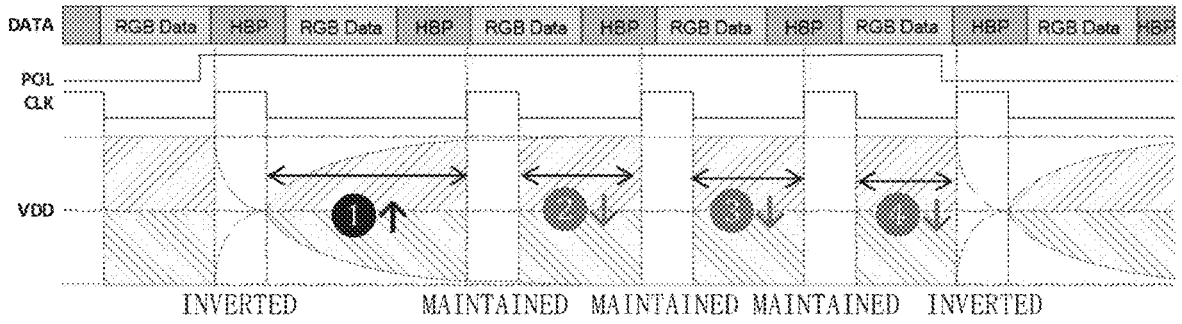
FIG. 2 illustrates a waveform diagram of a signal applied to the liquid crystal display (LCD) when a Programmable Line Start Control (PLSC) function is used in prior art.
Figure 3:
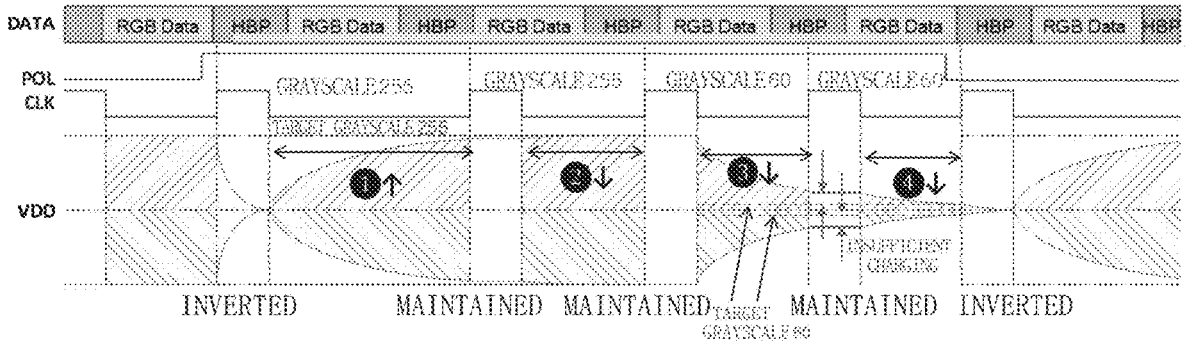
FIG. 3 illustrates a waveform diagram of a specific example of the signal applied to the LCD when the PLSC function is used in prior art.

In FIG. 6, a display device displays an image based on image data DATA and a control signal CONT input from outside. The timing controller 200 may generate a polarity control signal POL and an internal clock signal CLK. When the polarity control signal POL is switched between a high level and a low level, polarity of a data voltage is inverted in a subsequent pixel row, and when the polarity control signal POL is maintained at the high level or the low level, the polarity of the data voltage of the subsequent N−1 pixel rows is maintained. For example, in FIG. 6, when the polarity control signal POL is switched from the low level to the high level, the polarity of the data voltage is inverted in the subsequent pixel row, and when the polarity control signal POL is maintained at the high level, the polarity of the data voltage of the subsequent N−1 pixel rows is maintained. In the example shown in FIG. 6, N may be 4, and in other example embodiments, N may also be an integer such as 8, 16. The waveform diagram shown in FIG. 6 is substantially the same as that shown in FIGS. 2 and 3, except that the timing controller 200 shown in FIG. 1 is used to automatically adjust a grayscale value of the pixel row, and for convenience of explanation, only differences related to the description of FIGS. 2 and 3 are described herein.

In FIG. 6, an original grayscale value of the image data DATA corresponding to a first pixel row ① may be 255, an original grayscale value of the image data DATA corresponding to a second pixel row ② may be 255, an original grayscale value of the image data DATA corresponding to a third pixel row ③ may be 60, and an original grayscale value of the image data DATA corresponding to a fourth pixel row ④ may be 60. When switching from the grayscale of 255 of the second pixel row ② to the grayscale of 60 of the third pixel row ③, the timing controller 200 detects that the original grayscale of 60 of the third pixel row ③ is different from the original grayscale of 255 of the previous row (e.g. the second pixel row ②), and automatically adjusts the grayscale value of the third pixel row ③. For example, the grayscale value of the third pixel row ③ is adjusted to 40, and the adjusted grayscale value is output as a data signal.

In the example shown in FIG. 6, when the grayscale value of the third pixel row ③ is adjusted to 40, a real source level of the third pixel row ③ can be charged at a faster speed and a target level can be reached within a reduced time, thereby improving display effects. It will be understood that a numerical range of the example discussed above with reference to FIG. 6 is only used to illustrate the principle of the present disclosure, and should not be construed in any way to limit the scope of the disclosure.

Hereinafter, operations for the timing controller 200 to implement an automatic adjustment will be described in detail with reference to FIGS. 7 to 11.

Figure 7:
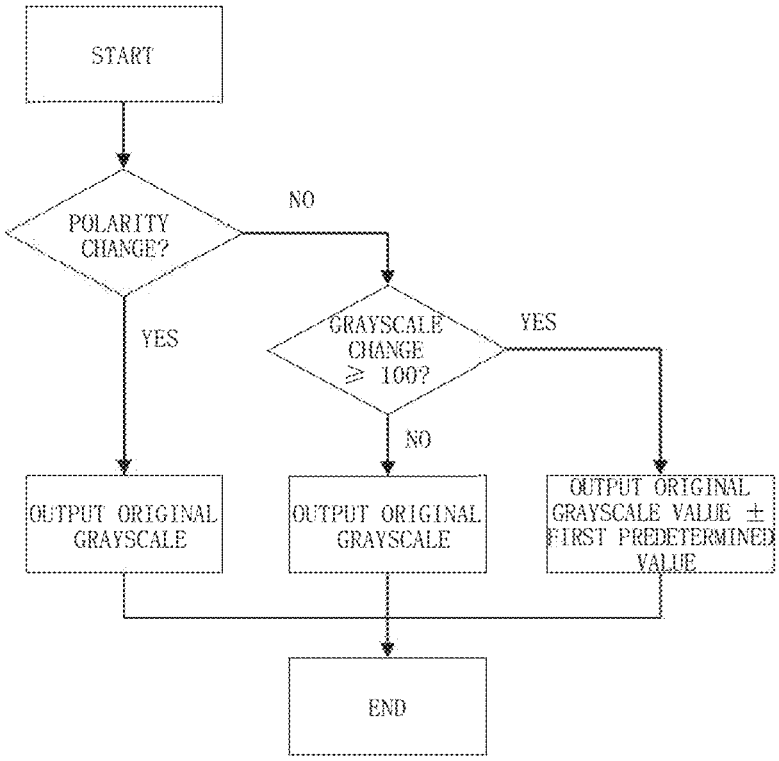
FIG. 7 illustrates a flowchart of an automatic adjustment processed by using a control circuit.

FIG. 7 illustrates a flowchart of an automatic adjustment processed by using a control circuit.

At first, the timing controller 200 receives an original grayscale value of a target pixel row and an original grayscale value of a previous pixel row. Then, the timing controller 200 determines whether polarity of the target pixel row is the same as that of the previous pixel row.

When the polarity of the target pixel row is different from that of the previous pixel row (polarity change: Yes), the timing controller 200 outputs the original grayscale value of the target pixel row as a data signal.

When the polarity of the target pixel row is the same as that of the previous pixel row (polarity change: No), the timing controller 200 determines whether a difference between the original grayscale value of the target pixel row and the original grayscale value of the previous pixel row is less than a first threshold.

When the difference between the original grayscale value of the target pixel row and the original grayscale value of the previous pixel row is less than the first threshold, the timing controller 200 outputs the original grayscale value of the target pixel row as the data signal.

When the difference between the original grayscale value of the target pixel row and the original grayscale value of the previous pixel row is larger than or equal to the first threshold, the timing controller 200 increases or decreases the original grayscale value of the target pixel row by a first predetermined or alternatively, desired value to determine an adjusted grayscale value of the target pixel row. Specifically, when the original grayscale value of the target pixel row is greater than that of the previous pixel row, the original grayscale value of the target pixel row is increased by the first predetermined or alternatively, desired value to determine the data signal; when the original grayscale value of the target pixel row is less than that of the previous pixel row, the original grayscale value of the target pixel row is decreased by the first predetermined or alternatively, desired value to determine the adjusted grayscale value of the target pixel row.

Here, the first threshold may be greater than 0 and less than 200, and the first predetermined or alternatively, desired value may be greater than 0 and less than 30. In some example embodiments, the first threshold is 100, and the first predetermined or alternatively, desired value is 1. It will be understood that a numerical range of the example discussed above with reference to FIG. 7 is only used to illustrate the principle of the present disclosure, and should not be construed in any way to limit the scope of the disclosure.

In some example embodiments, the automatic adjustment unit of the timing controller 200 may be implemented by a control circuit. A specific configuration of the control circuit is not limited, as long as the grayscale value of the target pixel row can be automatically adjusted. In example embodiments where the grayscale value of the target pixel row is adjusted as described above, a real source level of the target pixel row can be charged at a faster speed and a target level can be reached within a reduced time, thereby improving display effects.

Figure 8:
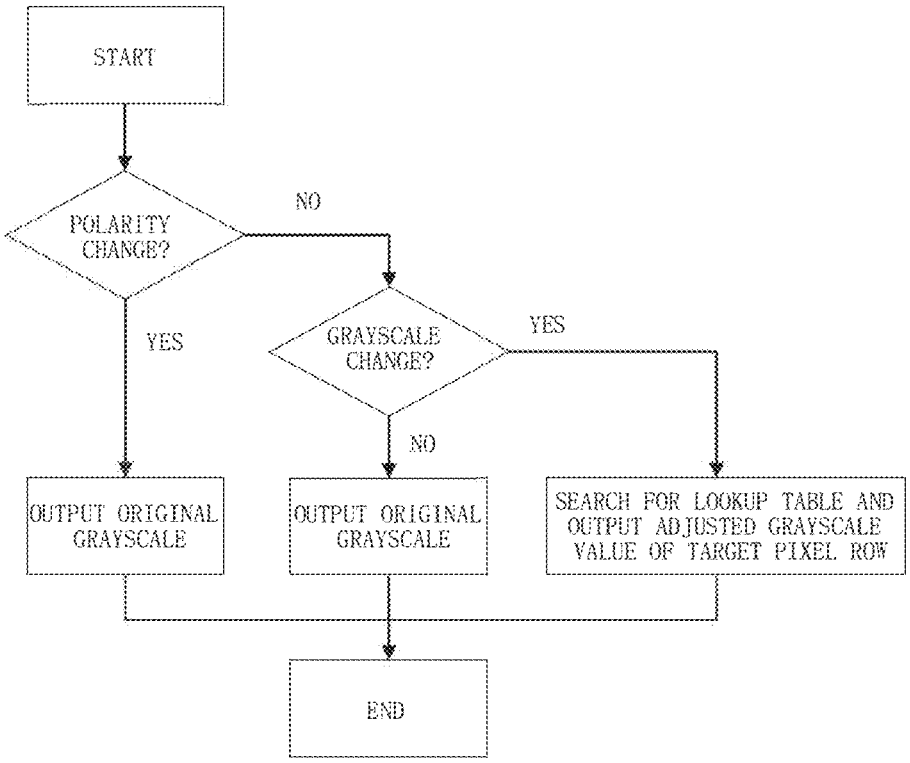
FIG. 8 illustrates a flowchart of an automatic adjustment processed by using a lookup table.

FIG. 8 illustrates a flowchart of an automatic adjustment processed by using a lookup table, and FIG. 9 illustrates an example of an automatic adjustment processed by using a lookup table.

The flowchart shown in FIG. 8 is substantially the same as that shown in FIG. 7, except that the automatic adjustment is processed by using the lookup table, and for convenience of explanation, only differences related to the description of FIG. 7 are described herein.

When polarity of a target pixel row is different from that of a previous pixel row (polarity change: Yes), or when the polarity of the target pixel row is the same as that of the previous pixel row (polarity change: No) and an original grayscale value of the target pixel row is the same as that of the previous pixel row, the timing controller 200 outputs the original grayscale value of the target pixel row as a data signal.

When the polarity of the target pixel row is the same as that of the previous pixel row (polarity change: No) and the original grayscale value of the target pixel row is different from that of the previous pixel row, the timing controller 200 determines an adjusted grayscale value of the target pixel row based on the lookup table according to the original grayscale value of the target pixel row and the original grayscale value of the previous pixel row.

Referring to FIG. 9, the grayscale value corresponding to the original grayscale value of the target pixel row and the original grayscale value of the previous pixel row is shown in FIG. 9. For example, when the original grayscale value of the target pixel row may be 48 and the original grayscale value of the previous pixel row may be 240, the adjusted grayscale value of the target pixel row may be 24. It will be understood that a numerical range of the example discussed above with reference to FIG. 9 is only used to illustrate the principle of the present disclosure, and should not be construed in any way to limit the scope of the disclosure.

When the grayscale value of the target pixel row is adjusted as described above, a real source level of the target pixel row can be charged at a faster speed and a target level can be reached within a reduced time, thereby improving display effects.

Figure 11:
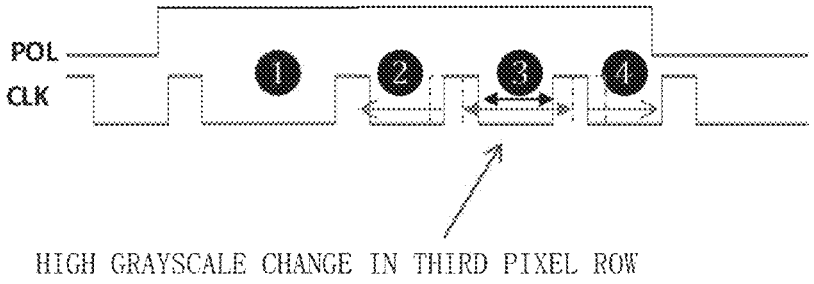
FIG. 11 illustrates a waveform diagram of an automatic adjustment for a clock signal.

FIG. 10 illustrates a flowchart of an automatic adjustment processed by adjusting a clock signal, and FIG. 11 illustrates a waveform diagram for automatically adjusting a clock signal.

The flowchart shown in FIG. 10 is substantially the same as that shown in FIGS. 7 and 8, except that the automatic adjustment is processed by adjusting the clock signal, and for convenience of explanation, only differences related to the description of FIGS. 7 and 8 are described herein.

When polarity of a target pixel row is different from that of a previous pixel row (polarity change: Yes), the timing controller 200 keeps an original PLSC clock signal setting unchanged.

When the polarity of the target pixel row is the same as that of the previous pixel row (polarity change: No), the timing controller 200 determines whether a difference between an original grayscale value of the target pixel row and an original grayscale value of the previous pixel row is less than a second threshold.

When the difference between the original grayscale value of the target pixel row and the original grayscale value of the previous pixel row is less than the second threshold, the timing controller 200 keeps the original PLSC clock signal setting unchanged.

When the difference between the original grayscale value of the target pixel row and the original grayscale value of the previous pixel row is greater than or equal to the second threshold, as for other pixel rows among a plurality of adjacent pixel rows loaded with data voltages of the same polarity except for a first pixel row, the timing controller 200 adjusts an on-width of an internal clock signal of the other pixel rows, such that the on-width of the internal clock signal of the target pixel row among the other pixel rows is greater than that of the remaining pixel rows among the other pixel rows. For example, the clock signal of the target pixel row is advanced, and/or the clock signal of the next pixel row is delayed. In some example embodiments, before and after the adjustment, a total duration of the internal clock signal corresponding to the other pixel rows would keep unchanged. In some example embodiments, the timing controller 200 and the data driver 300 may commonly adjust the internal clock signals of the other pixel rows. For example, the timing controller 200 may output a clock signal with a fixed on-width and a control command for controlling a change of the on-width of the clock signal to the data driver 300, and the data driver 300 generates an adjusted internal clock signal corresponding to the other pixel rows based on the received clock signal and the received control command.

Referring to FIG. 11, as for a plurality of adjacent pixel rows loaded with data voltages of the same polarity, according to the original PLSC clock signal setting, the on-width of the internal clock signal of a first pixel row ① is greater than that of the internal clock signals of the other pixel rows (a second pixel row ②, a third pixel row ③, and a fourth pixel row ④). In this example embodiment, when the difference between the original grayscale value of the third pixel row ③ and the original grayscale value of the second pixel row ② is greater than or equal to the second threshold, the timing controller 200 adjusts the on-width of the internal clock signal of the second pixel row ②, the third pixel row ③, and the fourth pixel row ④, such that the on-width of the internal clock signal of the third pixel row ③ is greater than that of the second pixel row ② and the fourth pixel row ④. For example, the clock signal of the third pixel row ③ is advanced, and/or the clock signal of the fourth pixel row ④ is delayed. In addition, after the adjustment, it is ensured that the total duration of the internal clock signals corresponding to the second pixel row ②, the third pixel row ③, and the fourth pixel row ④ keeps unchanged.

In some example embodiments, the second threshold may be greater than or equal to 200 and less than 255. In some example embodiments, the second threshold may be 200. It will be understood that a numerical range of the example discussed above with reference to FIG. 10 is only used to illustrate the principle of the present disclosure, and should not be construed in any way to limit the scope of the disclosure.

In some example embodiments, the operations of the automatic adjustment described with reference to FIG. 10 may be combined with the operations of the automatic adjustment described with reference to FIG. 7 or 8. For convenience of explanation, the redundant content is omitted.

In some example embodiments, the operations of the automatic adjustment described with reference to FIG. 7 may be performed first, and then the operations of the automatic adjustment described with reference to FIG. 10 are performed. In some example embodiments, the repeated operations can be omitted.

In addition, the numerical range of the example discussed with reference to FIG. 7 can be adaptively adjusted according to whether the automatic adjustment is processed by adjusting the clock signal or not. For example, an appropriate first threshold and first predetermined or alternatively, desired value can be selected to match the adjustment of the internal clock signal, and the second threshold can be greater than the first threshold described with reference to FIG. 7. For example, the determination of the polarity change may be performed only in the automatic adjustment operation described with reference to FIG. 7. In some example embodiments, when the polarity of the target pixel row is the same as the polarity of the previous pixel row (polarity change: No) and when the difference between the original grayscale value of the target pixel row and the original grayscale value of the previous pixel row is greater than or equal to the first threshold and less than the second threshold, the timing controller 200 determines the adjusted grayscale value of the target pixel row by increasing or decreasing the original grayscale value of the target pixel row by the first predetermined or alternatively, desired value; when the polarity of the target pixel row is the same as the polarity of the previous pixel row (polarity change: No) and when the difference between the original grayscale value of the target pixel row and the original grayscale value of the previous pixel row is greater than or equal to the second threshold, the timing controller 200 determines the adjusted grayscale value of the target pixel row by increasing or decreasing the original grayscale value of the target pixel row by the first predetermined or alternatively, desired value, and the data driver 300 advances the clock signal of the target pixel row and/or delays the clock signal of the next pixel row.

In some example embodiments, the operations of the automatic adjustment described with reference to FIG. 8 may be performed first, and then the operations of the automatic adjustment described with reference to FIG. 10 are performed. In some example embodiments, the repeated operations can be omitted. For example, the determination of the polarity change may be performed only in the automatic adjustment operation described with reference to FIG. 8. In addition, the numerical range of the example discussed with reference to FIG. 8 can be adaptively adjusted according to whether the automatic adjustment is processed by adjusting the clock signal or not.

One or more of the elements disclosed above may include or be implemented in one or more processing circuitries such as hardware including logic circuits; a hardware/software combination such as a processor executing software; or a combination thereof. For example, the processing circuitries more specifically may include, but is not limited to, a central processing unit (CPU), an arithmetic logic unit (ALU), a digital signal processor, a microcomputer, a field programmable gate array (FPGA), a System-on-Chip (SoC), a programmable logic unit, a microprocessor, application-specific integrated circuit (ASIC), etc.

Example embodiments of the present disclosure have been described above. It should be understood that the foregoing description is only example and not exhaustive, and the present disclosure is not limited to the disclosed example embodiments. Many modifications and changes are apparent to those of ordinary skill in the art without departing from the scope and spirit of the present disclosure. Therefore, the protection scope of the present disclosure shall be determined by the scope of the accompanying claims.

What is claimed is:

1. A liquid crystal display device, comprising:

a display panel configured to display an image;

a gate driver configured to output a gate signal to a gate line of the display panel;

a data driver configured to output a data voltage to a data line of the display panel; and a timing controller configured to control operations of the gate driver and the data driver, and the timing controller configured to output a data signal, an internal clock signal, and a polarity control signal to the data driver based on image data input externally, wherein the data driver is configured to invert polarity of the data voltage for n (where n is an integer greater than or equal to 2) number of rows based on the polarity control signal, and in a plurality of adjacent pixel rows loaded with data voltages of the same polarity, an on-width of the internal clock signal of a first pixel row is greater than that of the internal clock signals of other pixel rows; and wherein when an original grayscale value of a target pixel row in the other pixel rows, included in the image data, is different from the original grayscale value of a previous pixel row in the other pixel rows, included in the image data, the timing controller is configured to automatically adjust the grayscale value of the target pixel row from the original value included in the image data, and output the adjusted grayscale value as the data signal of the target pixel row.

2. The liquid crystal display device of claim 1, wherein when a difference between the original grayscale value of the target pixel row and the original grayscale value of the previous pixel row is less than a first threshold, the timing controller is configured to output the original grayscale value of the target pixel row as the data signal; and when the difference between the original grayscale value of the target pixel row and the original grayscale value of the previous pixel row is larger than or equal to the first threshold, the timing controller is configured to increase or decrease the original grayscale value of the target pixel row by a first value to determine the adjusted grayscale value of the target pixel row.

3. The liquid crystal display device of claim 2, wherein the first threshold is 100, and the first value is 1.

4. The liquid crystal display device of claim 2, wherein when the difference between the original grayscale value of the target pixel row and the original grayscale value of the previous pixel row is greater than or equal to a second threshold, the timing controller is configured to adjust the on-width of the internal clock signal of the other pixel rows, such that the on-width of the internal clock signal of the target pixel row among the other pixel rows is greater than that of remaining pixel rows among the other pixel rows, wherein the second threshold is greater than the first threshold.

5. The liquid crystal display device of claim 4, wherein the second threshold is 200.

6. The liquid crystal display device of claim 1, wherein when the original grayscale value of the target pixel row is different from that of the previous pixel row, the timing controller is configured to determine the adjusted grayscale value of the target pixel row based on a lookup table according to the original grayscale value of the target pixel row and the original grayscale value of the previous pixel row.

7. The liquid crystal display device of claim 6, wherein when the difference between the original grayscale value of the target pixel row and the original grayscale value of the previous pixel row is greater than or equal to a threshold, the timing controller is configured to adjust the on-width of the internal clock signal of the other pixel rows, such that the on-width of the internal clock signal of the target pixel row among the other pixel rows is greater than that of the remaining pixel rows among the other pixel rows.

8. The liquid crystal display device of claim 7, wherein the threshold is 200.

9. A method for driving a liquid crystal display comprising:

inverting polarity of a data voltage for n (where n is an integer greater than or equal to 2) number of rows based on a polarity control signal, and in a plurality of adjacent pixel rows loaded with data voltages of the same polarity, an on-width of an internal clock signal of a first pixel row is greater than that of internal clock signals of other pixel rows; and automatically adjusting a grayscale value from an scale value included in image data of a target pixel row, and outputting the adjusted grayscale value as the data signal of the target pixel row when the original grayscale value, included in the image data, of the target pixel row in the other pixel rows is different from the original grayscale value, included in the image data, of a previous pixel row in the other pixel rows.

10. The method of claim 9, wherein when a difference between the original grayscale value of the target pixel row and the original grayscale value of the previous pixel row is less than a first threshold, the original grayscale value of the target pixel row is output as the data signal; and when the difference between the original grayscale value of the target pixel row and the original grayscale value of the previous pixel row is larger than or equal to the first threshold, the original grayscale value of the target pixel row is increased or decreased by a first value to determine the adjusted grayscale value of the target pixel row.

11. The methods of claim 10, wherein the first threshold is 100, and the first value is 1.

12. The methods of claim 10, wherein when the difference between the original grayscale value of the target pixel row and the original grayscale value of the previous pixel row is greater than or equal to a second threshold, the on-width of the internal clock signal of the other pixel rows is adjusted, such that the on-width of the internal clock signal of the target pixel row among the other pixel rows is greater than that of remaining pixel rows among the other pixel rows, wherein the second threshold is greater than the first threshold.

13. The method of claim 12, wherein the second threshold is 200.

14. The method of claim 9, wherein when the original grayscale value of the target pixel row is different from that of the previous pixel row, the adjusted grayscale value of the target pixel row is determined based on a lookup table according to the original grayscale value of the target pixel row and the original grayscale value of the previous pixel row.

15. The methods of claim 14, wherein when the difference between the original grayscale value of the target pixel row and the original grayscale value of the previous pixel row is greater than or equal to a threshold, the on-width of the internal clock signal of the other pixel rows is adjusted, such that the on-width of the internal clock signal of the target pixel row among the other pixel rows is greater than that of the remaining pixel rows among the other pixel rows.

16. The method of claim 15, wherein the threshold is 200.

* * * * *